US010306958B1

(12) United States Patent
Oligie et al.

(10) Patent No.: US 10,306,958 B1
(45) Date of Patent: Jun. 4, 2019

(54) ILLUMINATED WALKING CANE

(71) Applicants: Kingsley Oligie, Columbia, MD (US); Linda Gilmore-Oligie, Columbia, MD (US)

(72) Inventors: Kingsley Oligie, Columbia, MD (US); Linda Gilmore-Oligie, Columbia, MD (US)

( * ) Notice: Subject to any disclaimer, the term of this patent is extended or adjusted under 35 U.S.C. 154(b) by 0 days.

(21) Appl. No.: 15/819,187

(22) Filed: Nov. 21, 2017

(51) Int. Cl.

| | |
|---|---|
| ***A45B 3/04*** | (2006.01) |
| ***F21L 4/02*** | (2006.01) |
| ***F21L 4/08*** | (2006.01) |
| ***F21V 23/04*** | (2006.01) |
| ***F21Y 101/00*** | (2016.01) |
| ***F21Y 103/10*** | (2016.01) |
| ***F21Y 115/10*** | (2016.01) |

(52) U.S. Cl.
CPC *A45B 3/04* (2013.01); *F21L 4/02* (2013.01); *F21L 4/08* (2013.01); *F21V 23/0414* (2013.01); *F21Y 2101/00* (2013.01); *F21Y 2103/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 4,062,371 | A | 12/1977 | Bolen | |
| D278,387 | S | 4/1985 | Bixler | |
| 4,562,850 | A | 1/1986 | Earley | |
| 6,394,116 | B1 | 5/2002 | Winn | |
| 8,337,035 | B2 | 12/2012 | Lu | |
| 8,496,343 | B2 * | 7/2013 | Lee | A45B 3/04 135/65 |
| 8,517,555 | B1 * | 8/2013 | LeJeune | F21V 33/0068 135/65 |
| 8,985,802 | B2 | 3/2015 | Nievas | |
| 2004/0264172 | A1 | 12/2004 | Roberts | |

FOREIGN PATENT DOCUMENTS

| | | |
|---|---|---|
| WO | 2013090273 | 6/2013 |

* cited by examiner

*Primary Examiner* — Kristy A Haupt
(74) *Attorney, Agent, or Firm* — Kyle A. Fletcher, Esq.

(57) ABSTRACT

The illuminated walking cane is a mobility assistance device. The illuminated walking cane is configured for use with a person. The illuminated walking cane comprises a cane and an illumination system. The cane provides mobility assistance and support during use of the illuminated walking cane. The illumination system provides a general area illumination and a point illumination source for use in low light conditions.

15 Claims, 4 Drawing Sheets

ILLUMINATED WALKING CANE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles, more specifically, a walking stick combined with an electrically powered illumination device.

SUMMARY OF INVENTION

The illuminated walking cane is a mobility assistance device. The illuminated walking cane is configured for use with a person. The illuminated walking cane comprises a cane and an illumination system. The cane provides mobility assistance and support during use of the illuminated walking cane. The illumination system provides a general area illumination and a point illumination source for use in low light conditions.

These together with additional objects, features and advantages of the illuminated walking cane will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated walking cane in detail, it is to be understood that the illuminated walking cane is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated walking cane.

It is therefore important that the claims be regarded as including such equivalent construction insofar as they do not depart from the spirit and scope of the illuminated walking cane. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
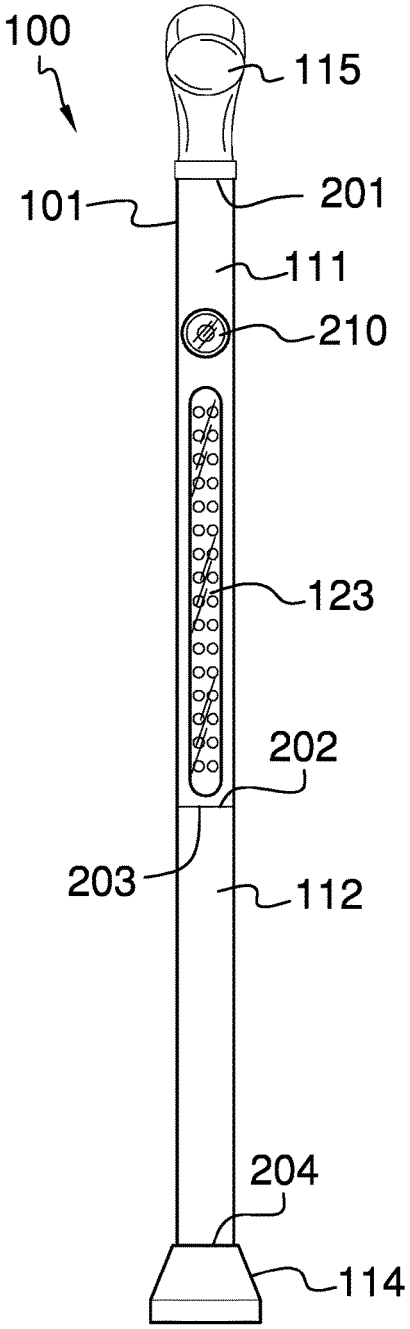
FIG. 1 is a front view of an embodiment of the disclosure.
Figure 2:
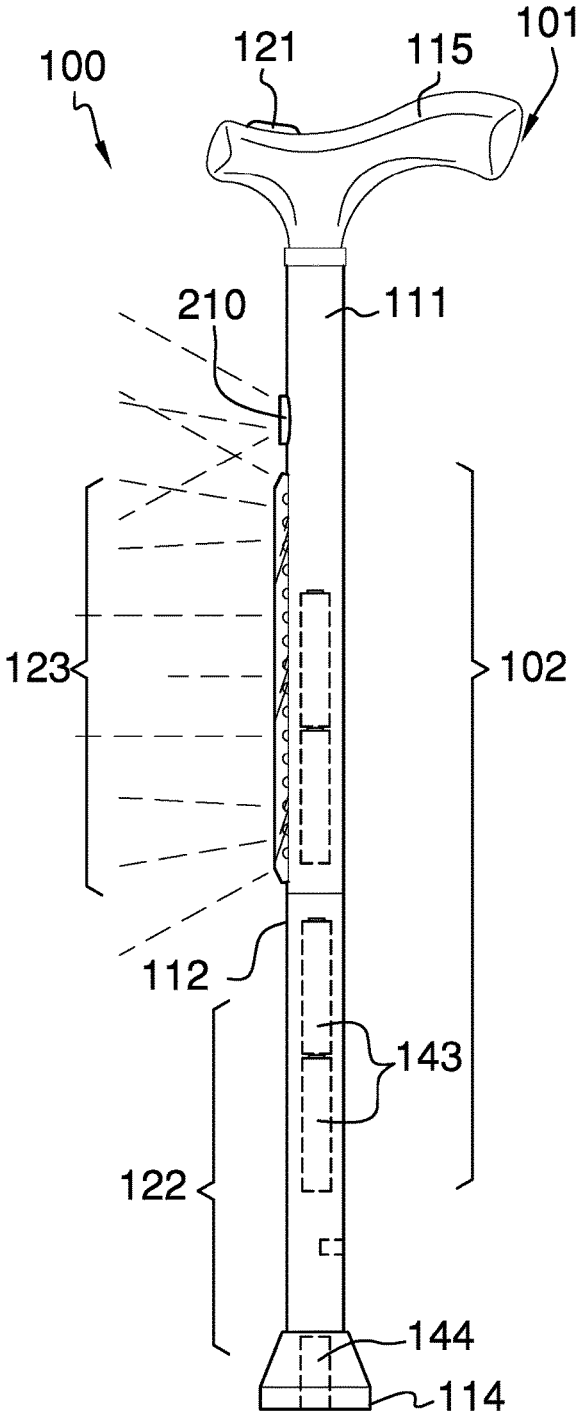
FIG. 2 is a side view of an embodiment of the disclosure.
Figure 3:
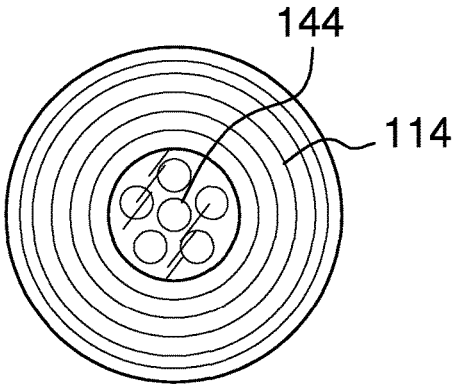
FIG. 3 is a bottom view of an embodiment of the disclosure.
Figure 4:
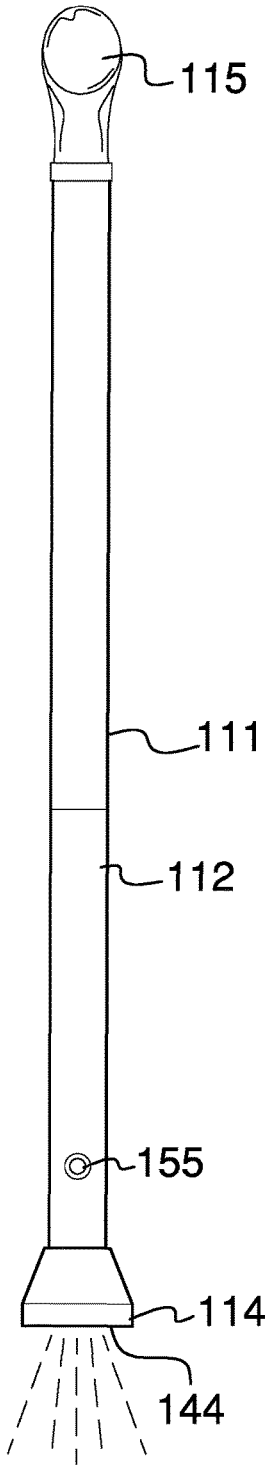
FIG. 4 is a rear view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The illuminated walking cane 100 (hereinafter invention) is a mobility assistance device. The invention 100 is configured for use with a person. The invention 100 comprises a cane 101 and an illumination system 102. The cane 101 provides mobility assistance and support during use of the invention 100. The illumination system 102 provides a general area illumination and a point illumination source for use in low light conditions.

The cane 101 is a well-known and documented mobility assistance device that is commonly used to assist a person when walking. The cane 101 comprises a superior shaft 111, an inferior shaft 112, a threaded connection 113, a cane tip 114, and a handle 115.

The threaded connection 113 is well-known and documented fastening device that attaches the superior shaft 111 to the inferior shaft 112. The threaded connection 113 is described in greater detail elsewhere in this disclosure. The threaded connection 113 comprises an exterior screw thread 131 and an interior screw thread 132. The exterior screw thread 131 is well-known and documented structure formed on the superior shaft 111 of the cane 101. The interior screw thread 132 is a well-known and documented structure formed on the inferior shaft 112 of the cane 101. The exterior screw thread 131 and the interior screw thread 132 are described in greater detail elsewhere in this disclosure.

The superior shaft 111 is a shaft formed as a hollow prism. The superior shaft 111 forms the superior structure of the cane 101. The superior shaft 111 is further defined with a first end 201 and a second end 202. The inferior shaft 112 is a shaft formed as a hollow prism. The inferior shaft 112 forms the inferior structure of the cane 101. The inferior shaft 112 is further defined with a third end 203 and a fourth end 204.

The cane tip 114 is a structure that attaches to the inferior shaft 112 of the cane 101. The cane tip 114 is formed from a non-skid material that prevents the cane 101 from slipping during use. The handle 115 is a grip that is attached to the superior shaft 111 of the cane 101.

The illumination system 102 is an enhancement to the cane 101. The illumination system 102 provides a general light source and a point light source that improves the visibility of the environment around the cane 101. The general light source generated by the illumination system 102 refers to the illumination of the area around the cane 101. The general light source is referred to in this disclosure as the walking light 123. The point light source generated by the illumination system 102 refers to a beam of illumination that can be aimed by the person to illuminate a specific location requiring illumination. The point light source is referred to in this disclosure as the flashlight 122. The illumination system 102 comprises a master switch 121, a flashlight 122, and a walking light 123.

The master switch 121 is a commercially available double pole single throw switch. The master switch 121 electrically connects the flashlight 122 to its power source. The master switch 121 electrically connects the walking light 123 to its power source. The master switch 121 is essentially the on-off switch of the invention 100. The master switch 121 is further defined with a first lead 171, a second lead 172, a third lead 173, and a fourth lead 174. As shown most clearly in FIG. 2, the master switch 121 is mounted in the handle 115 of the cane 101.

The flashlight 122 is the apparatus that generates the point light source of the invention 100. The flashlight 122 is installed in the inferior shaft 112 of the cane 101. The flashlight 122 comprises a first switch 141, a first limit resistor 142, a disposable battery 143, and a first LED point source 144. The first switch 141 is further defined with a fifth lead 175 and a sixth lead 176. The first limit resistor 142 is further defined with a ninth lead 179 and a tenth lead 180. The disposable battery 143 is further defined with a first positive terminal 183 and a first negative terminal 184. The first LED point source 144 is further defined with a first anode 187 and a first cathode 188.

The first switch 141 is a commercially available single pole single throw switch that controls the flow of electricity through the first LED point source 144. The first switch 141 controls the flow of electricity through the first LED point source 144. The first limit resistor 142 is a resistor that is placed in series between the first switch 141 and the first LED point source 144. The first limit resistor 142 limits the amount of current that flows through the first LED point source 144. The disposable battery 143 comprises one or more commercially available batteries that are not rechargeable. The first LED point source 144 is a structure that: 1) comprises one or more LEDs; and, 2) is assembled in a lens structure that projects the light generated by the one or more LEDs as a beam.

The walking light 123 is the apparatus that generates the general light source of the invention 100. The walking light 123 is installed in the superior shaft 111 of the cane 101. The walking light 123 comprises a second switch 151, a second limit resistor 152, a rechargeable battery 153, a diode 154, a charging port 155, and an LED strip 156. The walking light 123 is further configured for use with an external power source 161 and a charging plug 162. The second switch 151 is further defined with a seventh lead 177 and an eighth lead 178. The second limit resistor 152 is further defined with an eleventh lead 181 and a twelfth lead 182. The rechargeable battery 153 is further defined with a second positive terminal 185 and a second negative terminal 186. The LED strip 156 is further defined with a second anode 189 and a second cathode 190. The diode 154 is further defined with a third anode 191 and a third cathode 192.

The second switch 151 is a commercially available single pole single throw switch. The second switch 151 controls the flow of electricity into the LED strip 156. The second limit resistor 152 is a resistor that is placed in series between the second switch 151 and the LED strip 156. The second limit resistor 152 limits the amount of current that flows through the LED strip 156. The LED strip 156 is a commercially available structure that comprises a plurality of LEDs that are powered through a single power connection source. The use of an LED strip 156 is well-known and documented in the electrical and home decorating arts.

The rechargeable battery 153 comprises one or more commercially available rechargeable batteries 153. The chemical energy stored in the rechargeable battery 153 is renewed and restored through the use of the charging port 155. The charging port 155 is an electrical circuit that reverses the polarity of the rechargeable battery 153 and provides the energy necessary to reverse the chemical processes that the rechargeable battery 153 initially used to generate the electrical energy. This reversal of the chemical process creates a chemical potential energy that will later be used by the rechargeable battery 153 to generate electricity.

The charging port 155 attaches to an external power source 161 using a charging plug 162. The charging port 155 receives electrical energy from the external power source 161 through the charging plug 162. The diode 154 is an electrical device that allows current to flow in only one direction. The diode 154 is installed between the rechargeable battery 153 and the charging port 155 such that electricity will not flow from the second positive terminal 185 of the rechargeable battery 153 into the positive terminal of the external power source 161. In the first potential embodiment of the disclosure, the external power source 161 and the charging port 155 are compatible with USB power requirements. As shown most clearly in FIGS. 2 and 4, the charging port 155 is mounted in the inferior shaft 112.

Figure 5:
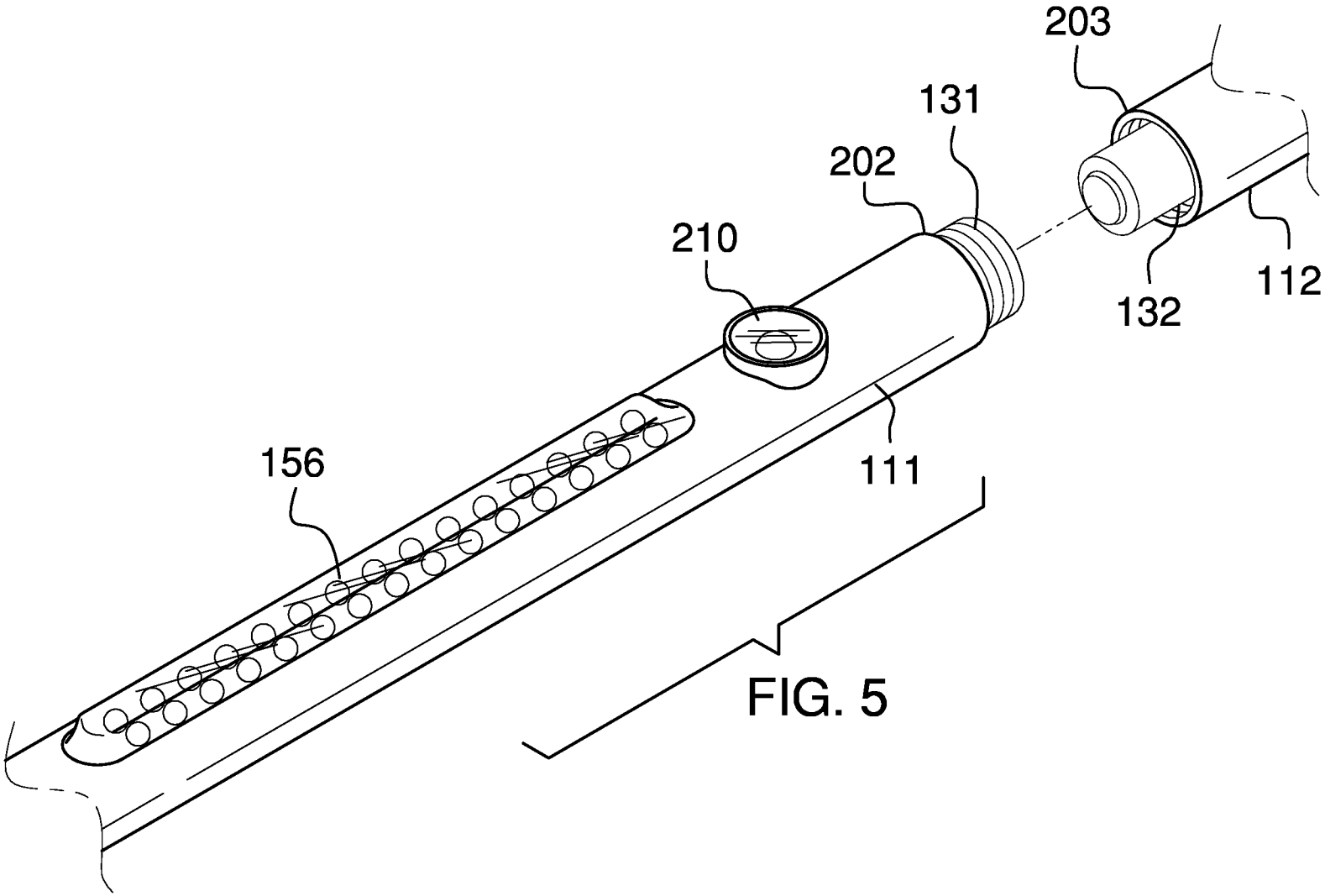
FIG. 5 is a detail view of an embodiment of the disclosure.
Figure 6:
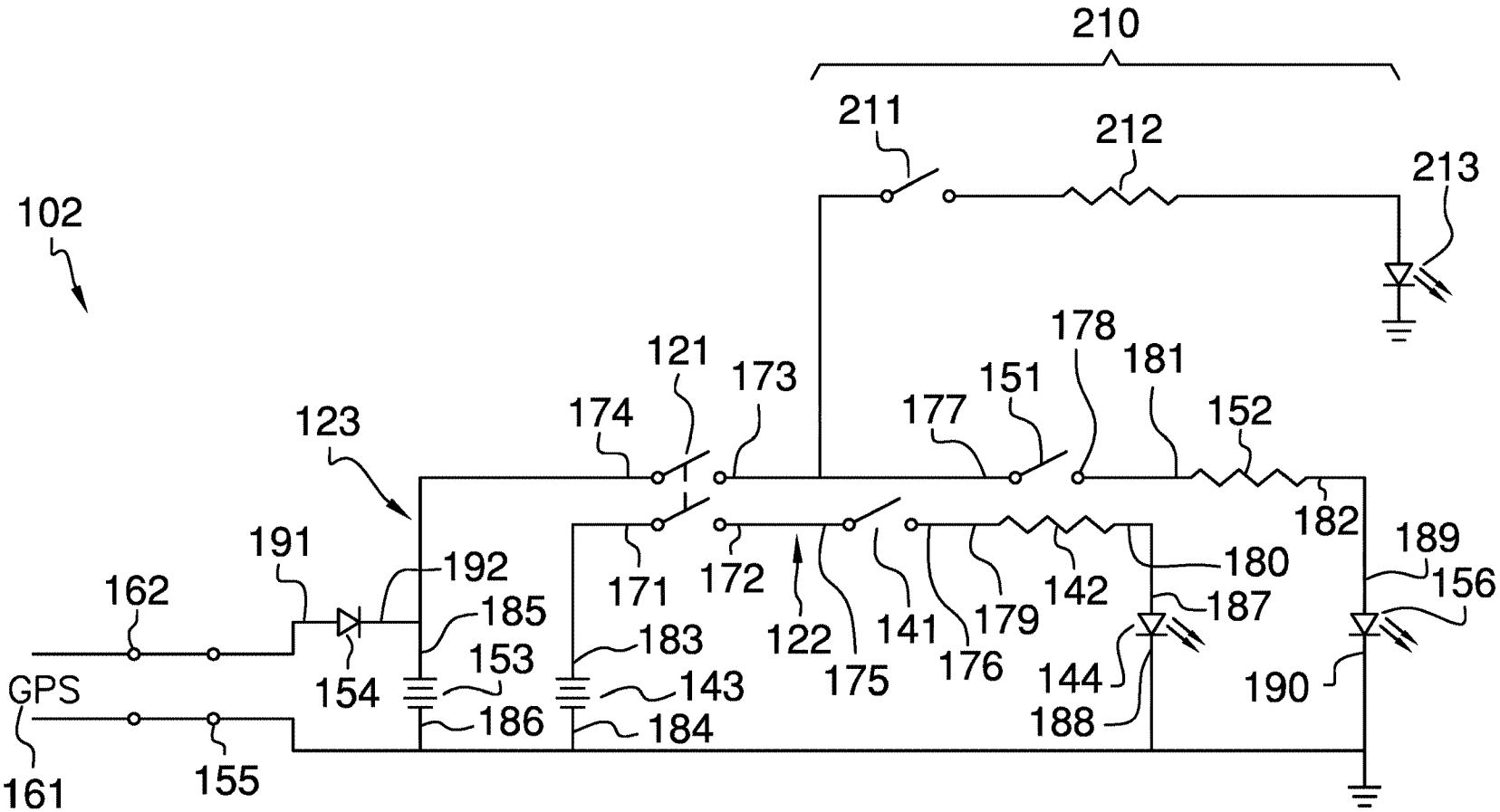
FIG. 6 is a schematic view of an embodiment of the disclosure.

In a second potential embodiment of the disclosure, as shown most clearly in FIGS. 1, 5, and 6, the invention 100 further comprises a flashlight 210. The flashlight 210 is mounted in the superior shaft 111 such that the flashlight 210 generates a point source of light that supplements light generated by the LED strip 156. The flashlight 210 comprises a third switch 211, a third limit resistor 212, and a second LED point source 213. The third switch 211, the third limit resistor 212, and the second LED point source 213 are wired in a series circuit. The series circuit comprising the third switch 211, the third limit resistor 212, and the second LED point source 213 is wired in parallel across the third lead 173 of the master switch 121 and the second cathode 190 of the LED strip 156.

The following seven paragraphs describe the assembly of the invention 100.

The first LED point source 144 is installed within the cane tip 114 such that the light beam generated by the first LED point source 144 leaves the cane tip 114 along the direction of the center axis of the cane 101. The cane tip 114 attaches to the fourth end 204 of the inferior shaft 112.

The interior screw thread 132 is formed on the third end 203 of the inferior shaft 112. The exterior screw thread 131 is formed on the interior surface of the second end 202 of the superior shaft 111. The disposable battery 143 is inserted into the third end 203 of the inferior shaft 112. The third end 203 of the inferior shaft 112 attaches to the second end 202 of the superior shaft 111 by screwing the exterior screw thread 131 into the interior screw thread 132 to form the threaded connection 113. The handle 115 attaches to the first end 201 of the superior shaft 111.

The master switch 121 is arranged such that when the master switch 121 is closed: 1) the first lead 171 electrically connects to the second lead 172; and, 3) the third lead 173 electrically connects to the fourth lead 174.

The third anode 191 of the diode 154 electrically connects to the charging port 155. The third cathode 192 of the diode 154 electrically connects to the second positive terminal 185 of the rechargeable battery 153. The second positive terminal 185 of the rechargeable battery 153 electrically connects to the fourth lead 174 of the master switch 121.

The third lead 173 of the master switch 121 electrically connects to the seventh lead 177 of the second switch 151. The eighth lead 178 of the second switch 151 electrically connects to the eleventh lead 181 of the second limit resistor 152. The twelfth lead 182 of the second limit resistor 152 electrically connects to the second anode 189 of the LED strip 156.

The first positive terminal 183 of the disposable battery 143 electrically connects to the first lead 171 of the master switch 121. The second lead 172 of the master switch 121 electrically connects to the fifth lead 175 of the first switch 141. The sixth lead 176 of the first switch 141 electrically connects to the ninth lead 179 of the first limit resistor 142. The tenth lead 180 of the first limit resistor 142 electrically connects to the first anode 187 of the first LED point source 144.

The second cathode 190 of the LED strip 156 electrically connects to the second negative terminal 186 of the rechargeable battery 153. The first cathode 188 of the first LED point source 144 electrically connects to the second negative terminal 186 of the rechargeable battery 153. The first negative terminal 184 of the disposable battery 143 electrically connects to the second negative terminal 186 of the rechargeable battery 153. The second negative terminal 186 of the rechargeable battery 153 electrically connects to the charging port 155.

The following definitions were used in this disclosure:

Battery: As used in this disclosure, a battery is a chemical device consisting of one or more cells, in which chemical energy is converted into electricity and used as a source of power.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Diode: As used in this disclosure, a diode is a two terminal semiconductor device that allows current flow in only one direction. The two terminals are called the anode and the cathode. Electric current is allowed to pass from the anode to the cathode.

Disposable: As used in this disclosure, disposable is an adjective that refers to an object that is designed and intended for a single use. Within this context, an object would be considered disposable if it is not reusable after its initial use.

External Power Source: As used in this disclosure, an external power source is a source of the energy that is externally provided to enable the operation of the present disclosure. Examples of external power sources include, but are not limited to, electrical power sources and compressed air sources.

Exterior Screw Thread: An exterior screw thread is a ridge wrapped around the outer surface of a tube in the form of a helical structure that is used to convert rotational movement into linear movement.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Inferior: As used in this disclosure, the term inferior refers to an edge or surface of an object that would commonly be referred to as the bottom of the object.

Interior Screw Thread: An interior screw thread is a groove that is formed around the inner surface of a tube in the form of a helical structure that is used to convert rotational movement into linear movement.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Maintained Switch: A used in this disclosure, a maintained switch is a switch that maintains the position that was set in the most recent switch actuation. A maintained switch works in an opposite manner to a momentary switch.

Non-Skid Material: As used in this disclosure, a non-skid material is a commercially available product that can be applied to an object such that the object is inhibited from sliding along the surface upon which the object is resting.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Screw: As used in this disclosure, to screw is a verb meaning: 1) to fasten or unfasten (unscrew) a threaded connection; or 2) to attach a helical structure to a solid structure.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Superior: As used in this disclosure, the term superior refers to an edge or surface of an object that would commonly be referred to as the top of the object.

Threaded Connection: As used in this disclosure, a threaded connection is a type of fastener that is used to join a first tube shaped and a second tube shaped object together. The first tube shaped object is fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An illuminated mobility assistance device comprising:
- a cane and an illumination system;
- wherein the illumination system attaches to the cane;
- wherein the illuminated mobility assistance device is configured for use with a person;
- wherein the cane provides mobility assistance and support during use of the illuminated mobility assistance device;
- wherein the illumination system provides a general area illumination and a point illumination source for use in low light conditions;
- wherein the cane comprises a superior shaft, an inferior shaft, a threaded connection, a cane tip, and a handle;
- wherein the threaded connection attaches the superior shaft to the inferior shaft;
- wherein the cane tip attaches to the inferior shaft;
- wherein the handle attaches to the superior shaft;
- wherein the threaded connection comprises an exterior screw thread and an interior screw thread;
- wherein the exterior screw thread attaches to the interior screw thread;
- wherein the superior shaft is a shaft formed as a hollow prism;
- wherein the inferior shaft is a shaft formed as a hollow prism;
- wherein the superior shaft is further defined with a first end and a second end;
- wherein the inferior shaft is further defined with a third end and a fourth end;
- wherein the cane tip is formed from a non-skid material that prevents the cane from slipping during use;
- wherein the illumination system comprises a master switch, a flashlight, and a walking light;
- wherein the master switch, the light switch, and the walking light are electrically interconnected;
- wherein the flashlight generates the point light source;
- wherein the walking light is the apparatus generates the general light source.

2. The illuminated mobility assistance device according to claim 1
- wherein the master switch is a double pole single throw switch;
- wherein the master switch electrically connects the flashlight to a disposable battery;
- wherein the master switch electrically connects the walking light to a rechargeable battery;
- wherein the master switch is further defined with a first lead, a second lead, a third lead, and a fourth lead.

3. The illuminated mobility assistance device according to claim 2
- wherein the flashlight comprises a first switch, a first limit resistor, the disposable battery, and an first LED point source;
- wherein first switch, the first limit resistor, the disposable battery, and the first LED point source are electrically interconnected;
- wherein the first switch is further defined with a fifth lead and a sixth lead;
- wherein the first limit resistor is further defined with a ninth lead and a tenth lead;
- wherein the disposable battery is further defined with a first positive terminal and a first negative terminal;
- wherein the first LED point source is further defined with a first anode and a first cathode.

4. The illuminated mobility assistance device according to claim 3 wherein the first switch is a single pole single throw switch;

wherein the first limit resistor is a resistor;

wherein the first switch controls the flow of electricity through the first LED point source;

wherein the first limit resistor limits the amount of current that flows through the first LED point source;

wherein the first LED point source is a structure comprises one or more LEDs;

wherein the first LED point source is assembled in a lens structure that projects the light generated by the one or more LEDs as a beam.

5. The illuminated mobility assistance device according to claim 4 wherein the flashlight is installed in the inferior shaft of the cane.

6. The illuminated mobility assistance device according to claim 5 wherein the walking light comprises a second switch, a second limit resistor, the rechargeable battery, a diode, a charging port, and an LED strip;

wherein the second switch, the second limit resistor, the rechargeable battery, the diode, the charging port, and the LED strip are electrically interconnected;

wherein the second switch is further defined with a seventh lead and an eighth lead;

wherein the second limit resistor is further defined with an eleventh lead and a twelfth lead;

wherein the rechargeable battery is further defined with a second positive terminal and a second negative terminal;

wherein the LED strip is further defined with a second anode and a second cathode;

wherein the diode is further defined with a third anode and a third cathode.

7. The illuminated mobility assistance device according to claim 6 wherein the walking light is further configured for use with an external power source and a charging plug;

wherein the external power source electrically connects with the charging plug;

wherein the charging plug electrically connects with the charging port.

8. The illuminated mobility assistance device according to claim 7 wherein the second switch is a single pole single throw switch;

wherein the second limit resistor is a resistor;

wherein the LED strip is an electrical structure that comprises a plurality of LED that are powered through a single power connection;

wherein the second switch controls the flow of electricity into the LED strip;

wherein the second limit resistor limits the amount of current that flows through the LED strip.

9. The illuminated mobility assistance device according to claim 8 wherein the charging port is an electrical circuit that reverses the polarity of the rechargeable battery and provides the energy necessary to reverse the chemical processes that the rechargeable battery initially used to generate the electrical energy;

wherein the charging port electrically connects to an external power source using a charging plug;

wherein the charging port receives electrical energy from the external power source through the charging plug.

10. The illuminated mobility assistance device according to claim 9 wherein the diode is an electrical device that allows current to flow in only one direction;

wherein the diode is installed between the rechargeable battery and the charging port such that electricity will not flow from the second positive terminal of the rechargeable battery into the positive terminal of the external power source.

11. The illuminated mobility assistance device according to claim 10 wherein the walking light is installed in the superior shaft of the cane.

12. The illuminated mobility assistance device according to claim 11 wherein the first LED point source is installed within the cane tip such that the light beam generated by the first LED point source leaves the cane tip along the direction of the center axis of the cane;

wherein the cane tip attaches to the fourth end of the inferior shaft;

wherein the interior screw thread is formed on the third end of the inferior shaft;

wherein the exterior screw thread is formed on the interior surface of the second end of the superior shaft;

wherein the disposable battery is inserted into the third end of the inferior shaft;

wherein the third end of the inferior shaft attaches to the second end of the superior shaft by screwing the exterior screw thread into the interior screw thread to form the threaded connection;

wherein the handle attaches to the first end of the superior shaft.

13. The illuminated mobility assistance device according to claim 12 wherein the master switch is arranged such that when the master switch is closed the first lead electrically connects to the second lead;

wherein the master switch is arranged such that when the master switch is closed the third lead electrically connects to the fourth lead;

wherein the third anode of the diode electrically connects to the charging port;

wherein the third cathode of the diode electrically connects to the second positive terminal of the rechargeable battery;

wherein the second positive terminal of the rechargeable battery electrically connects to the fourth lead of the master switch;

wherein the third lead of the master switch electrically connects to the seventh lead of the second switch;

wherein the eighth lead of the second switch electrically connects to the eleventh lead of the second limit resistor;

wherein the twelfth lead of the second limit resistor electrically connects to the second anode of the LED strip.

14. The illuminated mobility assistance device according to claim 13 wherein the first positive terminal of the disposable battery electrically connects to the first lead of the master switch;

wherein the second lead of the master switch electrically connects to the fifth lead of the first switch;

wherein the sixth lead of the first switch electrically connects to the ninth lead of the first limit resistor;

wherein the tenth lead of the first limit resistor electrically connects to the first anode of the first LED point source;

wherein the second cathode of the LED strip electrically connects to the second negative terminal of the rechargeable battery;

wherein the first cathode of the first LED point source electrically connects to the second negative terminal of the rechargeable battery;

wherein the first negative terminal of the disposable battery electrically connects to the second negative terminal of the rechargeable battery;

wherein the second negative terminal of the rechargeable battery electrically connects to the charging port.

15. The illuminated mobility assistance device according to claim 14 wherein the illuminated mobility assistance device further comprises a flashlight;

wherein the flashlight is mounted in the superior shaft such that the flashlight generates a point source of light;

wherein the flashlight comprises a third switch, a third limit resistor, and a second LED point source;

wherein the third switch, the third limit resistor, and the second LED point source are wired in a series circuit;

wherein the series circuit comprising the third switch, the third limit resistor, and the second LED point source is wired in parallel across the third lead of the master switch and the second cathode of the LED strip.

* * * * *